US006450133B1

(12) United States Patent
Bernard et al.

(10) Patent No.: US 6,450,133 B1
(45) Date of Patent: Sep. 17, 2002

(54) PARTITIONED CONTAINER FOR HIGH OUTPUT MOBILE GENERATOR

(75) Inventors: Pierre Bernard, Pierrefonds; François Gélinas, Montreal; Stéphane Gagnon, St-Joseph-du-lac, all of (CA)

(73) Assignee: Solutions Jupiter Inc., Dorval (CA)

( * ) Notice: Subject to any disclaimer, the term of this patent is extended or adjusted under 35 U.S.C. 154(b) by 0 days.

(21) Appl. No.: 09/664,783

(22) Filed: Sep. 19, 2000

(51) Int. Cl.[7] ..... F01P 1/00
(52) U.S. Cl. ..... 123/2; 123/41.49; 454/118
(58) Field of Search ..... 123/2, 41.49, 41.51; 454/118

(56) References Cited

U.S. PATENT DOCUMENTS 1,691,598 A * 11/1928 Zbinden
2,124,523 A * 7/1938 Blanton
3,347,310 A * 10/1967 Lind et al.
3,404,732 A * 10/1968 Mork
4,272,967 A * 6/1981 White et al.
5,515,816 A * 5/1996 Ball et al.
5,678,512 A * 10/1997 Colton ..... 123/2
6,230,667 B1 * 5/2001 Stauffer et al. ..... 123/2

* cited by examiner

*Primary Examiner*—Harold Joyce

(57) ABSTRACT

The container or trailer is separated into three inner compartments: a rear compartment in which the motor of the power generator is located, a front compartment in which the radiators for cooling the motor are located, with the radiators being operatively linked to the motor in a conventional fashion with cooling fluid pipes, and an intermediate compartment between the front and rear compartments. Air channels link the front compartment with the intermediate compartment, and the rear compartment with the intermediate compartment. A first fresh air intake port is provided in the trailer side wall in the rear compartment, for cooling the flywheel of the motor, and a second fresh air intake port is provided in the trailer side wall in the front compartment, for cooling the radiators. A warm air outlet port is provided in the trailer ceiling in the intermediate compartment. A plenum fan is operatively installed in the intermediate compartment, sucking in air from both the front and rear compartments, and exhausting through the outlet port.

18 Claims, 4 Drawing Sheets

PARTITIONED CONTAINER FOR HIGH OUTPUT MOBILE GENERATOR

FIELD OF THE INVENTION

This invention relates to mobile generators used to provide electricity to remote areas not connected to the public utility electricity grid, or alternately to connected areas that suffer from an extended power outage.

BACKGROUND OF THE INVENTION

It is known to provide a high-output power generating unit inside a container, such as in a semi-trailer. One particular layout of such a container includes three sub-chambers inside the container, namely a rear chamber wherein a power generating motor is installed (and other elements such as a muffler, a flywheel, etc . . . ), a front chamber wherein a radiator assembly is installed, and an intermediate chamber therebetween. Air intake ports are provided in both the front and rear chambers, and an air outlet port is provided in both the front and intermediate chambers. The intermediate chamber is sealed relative to the front chamber, with a fluid-tight wall, while a through-channel, with a first fan therein, links the intermediate and rear chambers. In use, coolant air is sucked into the rear chamber by the first fan, to cool the motor (and more particularly the flywheel thereof), and the warm air is expelled, into the intermediate chamber, to be redirected out of the container through the intermediate chamber outlet port. In the front chamber, a set of fans are installed at the front chamber outlet port to suck fresh air into the front chamber, to cool the radiators, this air then being expelled through the front chamber outlet port outside of the container.

All air outlet ports are installed in the ceiling of the containers, to prevent warm air exhausts from being expelled directly above ground where people are likely to be standing.

A first problem with such a power generator and container assembly, is that the set of fans, e.g. consisting of three coplanar conventional "flat" fans having radially-extending blades, located at the front chamber outlet port, are very noisy. Indeed, each fan will not always rotate in a precisely synchronized fashion relative to the other fans, which will cause a pulsating aerodynamic noise. Additionally, each fan will furthermore cause a slight turbulence for the other fans, increasing the noise emitted by the fans. Finally, due to the high heat dissipated by the radiators of industrial power generators, a single flat fan is not enough to evacuate the generated heat, and consequently three fans instead of a single one are used, thus increasing production cost of the power generator unit, and power consumption.

Another disadvantage of the above-mentioned system is that ultimately, two exhaust systems are used. Indeed, the radiators use a first exhaust system, while the rear motor uses a second exhaust system. This requires two distinct outlet port openings to be provided in the semi-trailer container, and also requires at least two distinct fans with corresponding motors linked to the power generating motor of the generator unit. Thus, production costs are increased, as are maintenance costs and power consumption.

OBJECTS OF THE INVENTION

An object of this invention is to provide a high output mobile generator, which will be very quiet in operation and will generate minimal ground vibrations.

Another object of this invention is to provide a convenient and easy to use mobile generator, which will be of easy maintenance.

A general object of the present invention is to temporarily address the needs of electricity supply for those that have short term needs that cannot be fulfilled by public utility systems.

Another object of the present invention is to provide a power generating unit inside a container, with a single outlet port and a single fan for cooling both the power generating motor and the cooling radiators.

SUMMARY OF THE INVENTION

The present invention relates to a mobile generator unit comprising:

- a generally closed container having a peripheral wall defining an inner chamber;
- a first and a second transverse partition wall inside said container inner chamber separating said inner chamber into a first and a second compartments and an intermediate compartment between said first and second compartments;
- a power generating motor carried by said container in said first compartment;
- a radiator assembly carried by said container in said second compartment and operatively linked to said motor for cooling said motor;
- a first fresh air intake port provided in said trailer peripheral wall in said first chamber, for cooling said motor;
- a second fresh air intake port provided in said trailer peripheral wall in said second chamber, for cooling said radiator assembly;
- a hot air outlet port provided in said trailer peripheral wall in said intermediate chamber for exhausting warm air from said inner chamber;
- a first air channel linking said first and intermediate compartments;
- a second air channel linking said second and intermediate compartments; and
- an air fan assembly provided in said intermediate chamber and powered by said motor, for sucking air from said first and second compartments into said intermediate compartment and for expelling the air through said hot air outlet port.

Preferably, said air fan assembly is a plenum fan rotating about a rotational axis radially offset relative to said warm air outlet port.

Preferably, said plenum fan comprises a first and a second coaxially extending fan portions separated and integrally linked to a fan plate diametrally extending in said plenum fan between said first and second fan portions, said first fan portion being positioned in facing operative register with said first air channel and said second fan portion being positioned in facing operative register with said second air channel.

Preferably, said first and second fan portions have different axial lengths for corresponding respective air flow capacities.

Preferably, said second fan portion is axially longer than said first fan portion, for providing a greater air flow in said second compartment than in said first compartment.

Preferably, said first fan portion creates an air flow of approximately 20 000 CFM while said second fan portion creates an air flow of approximately 40 000 CFM.

Preferably, said mobile generator unit further comprises a third fresh air intake port in said second compartment, wherein said radiator assembly comprises a pair of radiators each positioned in facing, adjacent register with a respective one of said second and third fresh air intake ports.

Preferably, said peripheral wall defines a floor, two side walls, two end walls, and a ceiling, with said first and second fresh air intake port being provided in either one of said side walls and said end walls, and with said hot air outlet port being provided in said ceiling.

Preferably, said mobile generator unit further comprises a fluid containment vat located on said floor and including a bottom wall flatly resting on said floor, and two vat side walls and two vat end walls upstanding from said bottom wall in a fluid-tight manner.

Preferably, one of said container end walls is formed by a door that can be opened to allow access into said container, with said vat having a removable vat end wall registering with said door.

DETAILED DESCRIPTION OF THE PREFERRED EMBODIMENTS

Figure 1:
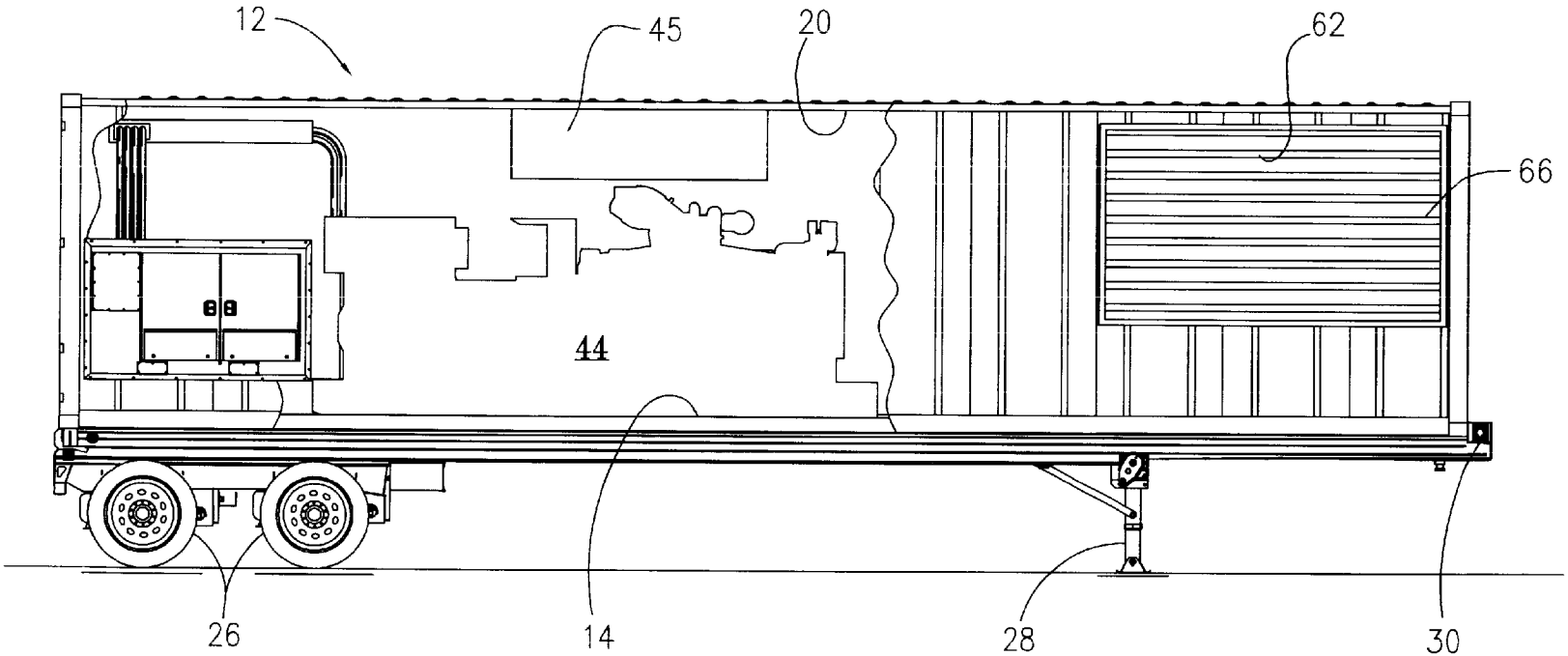
FIG. 1 is a side elevational view of an extended length trailer according to a first embodiment of the invention, shown partly broken for clarity of the view and showing a laterally mounted radiator assembly according to the invention.
Figure 2:
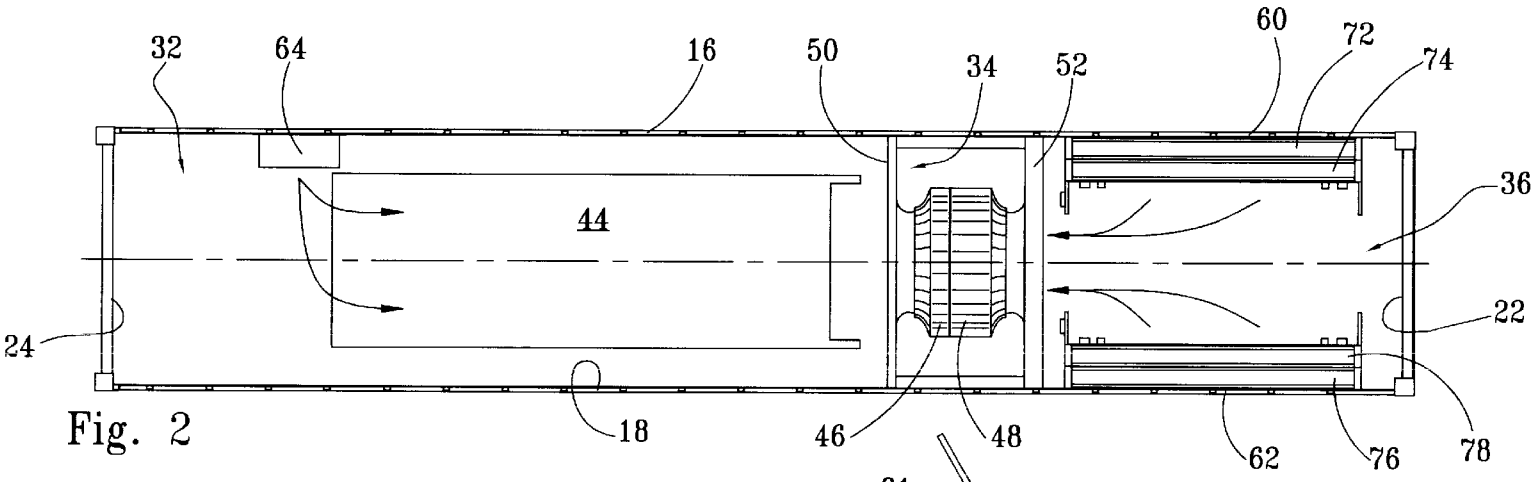
FIG. 2 is a horizontal top sectional view of the trailer of FIG. 1, suggesting the air flow pattern inside the front and rear compartment rooms thereof.
Figure 3:
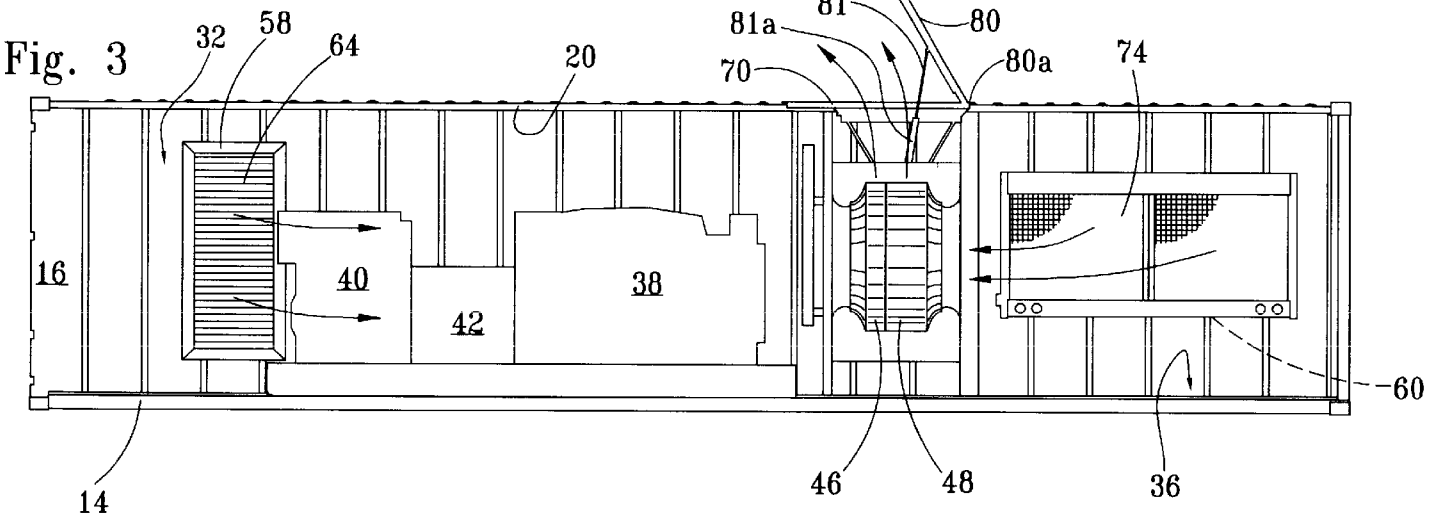
FIG. 3 is a vertical side elevation sectional view of the trailer of FIG. 1, also suggesting the air flow pattern inside the front and rear compartments thereof.

In FIGS. 1–3 of the drawings, there is shown a semi-trailer 12 having a peripheral wall defining a generally closed inner chamber (closed except for several required openings therein) and formed by a reinforced flooring 14, two opposite elongated lateral side walls 16, 18, a ceiling 20, and front and rear end walls 22, 24. A rear wheel and axle assembly 26 (e.g. two axles and four pairs of wheels) support the rear of the trailer 12 spacedly over ground, while a frontward tiltable support leg 28 supports the front portion of the trailer 12 spacedly over ground. A frontmost coupling unit 30 frontwardly depending from the flooring 14 is for releasable attachment to the fifth wheel of a pulling truck (not shown).

Three separate compartment rooms 32, 34, 36, are formed inside the trailer 12. Rear compartment room 32 houses the power generating motor member or generator 44 which includes a motor 38, a flywheel 40, and a drive 42 interconnecting the flywheel and the motor of the generator 44. A fuel tank (not shown) is provided to feed fuel to motor engine 38 via fuel lines (not shown); preferably, the fuel tank will be located inside front compartment 36 and supported directly by flooring 14. A muffler, schematically indicated at 45, is further provided inside rear compartment 32, and is linked to generator 44 in a known fashion.

Figure 4:
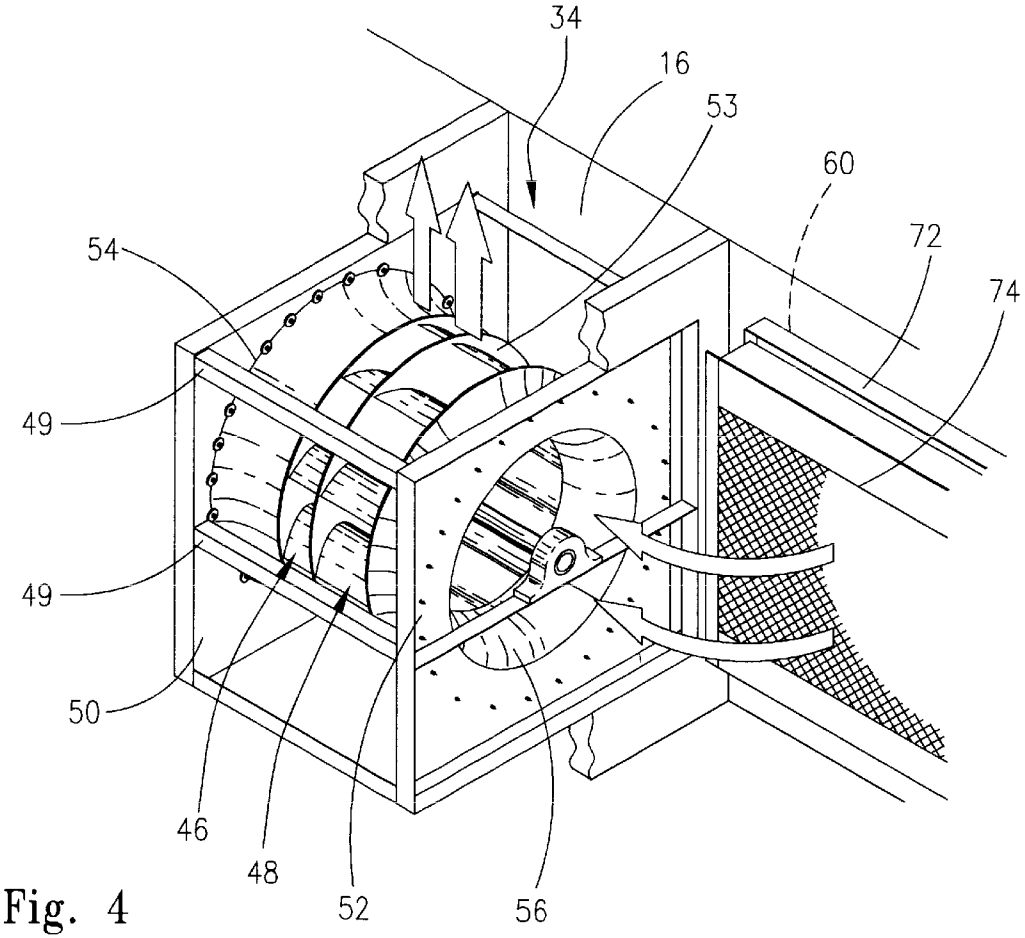
FIG. 4 is an enlarged perspective view of the air fan and part of the radiator assembly, suggesting the air flow pattern through the front end room compartment of the trailer and outwardly through the air outlet part of the roof.

Intermediate compartment room 34 houses a plenum fan assembly 46, 48 comprising a pair of back to back air fan portions 46, 48 which are integrally linked so as to form an integrally rotating fan assembly. The housing of fan assembly 46, 48, is transversely anchored to upright partition walls 50, 52, by transverse support struts 49, so that fan 46, 48 hangs freely spacedly over flooring 14. Fan assembly 46, 48 is a so-called plenum fan, which has the particularity of sucking gases axially and expelling these gases radially, as suggested in FIG. 4. To prevent undesirable turbulence from occurring inside fan assembly 46, 48 as a result of the two axially opposite air flows entering fan assembly 46, 48, a diametrally extending fan plate 53 separates and integrally links fan portions 46 and 48. As seen in FIGS. 2, 3 and 4, the rearmost fan 46 has blades which are axially shorter than the frontmost fan 48. Thus, as fan assembly 46, 48 rotates, a greater air flow is created through frontmost air fan 48 relative to rearmost air fan 46, to address the relative cooling requirements in front and rear compartments 36, 32. Air fan assembly 46, 48 is preferably driven by the generator motor 38 via an endless belt. In any event, a single fan drive is required to rotate the integral fan assembly 46, 48.

A first partition wall 50 separates rear and intermediate rooms 32, 34, and a second partition wall 52 separates intermediate and front rooms 34, 36. Walls 16–24 and 52–54 should be acoustically insulated with a layer of suitable insulating material, e.g. urethane. Air passages or channels 54, 56, are made through partitions walls 50, 52, and open into air fans 46, 48, respectively. A small rear air intake window 58 is formed inside rear room 32 at the rear portion of lateral side wall 16. in register with the flywheel 40, and a pair of opposite larger air intake windows 60, 62, are formed inside front room 36, at the front portion of lateral side walls 16 and 18. A first acoustic louver assembly 64 is mounted into rear window 58, and a pair of second acoustic louver assemblies 66, 66 are mounted into front windows 60, 62, as known in the art. to reduce the sound emissions outside of container or trailer 12.

An air outlet port 70 is made inside intermediate room 34 through ceiling 20 in register with the air fans 46, 48. The combustion gases generated by the generator motor 38 inside rear compartment 32, escape to the outside of the trailer through muffler 45 and an exhaust pipe (not shown) transversely through the trailer peripheral wall.

A pair of radiators panels 72, 74, and 76, 78, are applied against the inner face of each of the two opposite louver assemblies 66, 66, mounted into front air intake windows 60, 62, respectively, and operatively coupled by refrigerating fluid pipes (not shown) to the motor 38, as known in the art. Preferably, a foam strip is applied along the louver assembly peripheral frame 67 of louver assemblies 66, to be taken in sandwich between the adjacent radiator 72, 76, respectively.

In use, the motor engine refrigerating fluid circulating through these radiator panels 72, 74 are cooled by the fresh outside air sucked through windows 60, 62, and associated acoustically insulated louver assemblies 66, 66, and into the front compartment 36 by the rotating high output front air fan portion 48, and this hot air is thereafter expelled upwardly through the top outlet port 70 of the intermediate compartment 34. Furthermore, the flywheel 40 is cooled by the fresh outside air sucked by rotating smaller output rear air fan portion 46 through rear window 58 and associated sound insulated louver assembly 64 and into the rear compartment 32, and this hot air is thereafter expelled upwardly through the same top outlet port 70 of the intermediate compartment 34.

A sound insulated door 80 is hingedly mounted at 80*a* to ceiling 20 to releasably close the top warm air outlet port 70.

Door 80 is closed when the trailer 12 is in motion, but opened when the generator motor 38 (and associated air fans 46, 48) is operating. Ceiling door 80 may be operated by a ram 81 pivotally carried by a bracket 81*a* anchored to side wall 16.

According to the particular design of the trailer 12 of the invention, integral fan assembly 46, 48 can suck fresh cooling air through both the rear opening 58 and the front openings 60, 62 to cool distinct parts of the generator unit. Indeed, the plenum fan assembly 46, 48, in combination with the partitioned inner compartment 32, 34, 36, allows two distinct air flows to be created by a single fan assembly 46, 48, namely a rear air flow and a front air flow. The relative lengths of the blades of fans 46, 48 allow a greater front air flow to be created, which is desirable since the radiators 72, 74, 76, 78 require the most important cooling air flow, relative to the fly wheel 40. The combined hot air flows are expelled by plenum fan assembly 46, 48 radially out through the single trailer top outlet port 70.

For example, a twelve meter long trailer having the following specifications has been successfully tested by the applicant:

- power unit of 1,500 kilowatts@ 1,875 Kilovolts Amperes standby mode, or 1,250 Kilowatts@ 1,562 Kilovolts Amperes at prime mode;
- 277/480 volts, 60 Hertz, 3 phases, 4 wires, 0.8 power factor;
- with insulated bus multiple genset paralleling or utility paralleling capability;
- driven by diesel motor engine, 4 cycle, direct injection, 1,800 revolution per minutes, 2,220 brake horse power, standby cooled by two remote radiators;
- the fuel tank has a 2,000 U.S. gallons capacity to provide either 24 hours autonomy, in standby power mode, or 30 hours autonomy, in prime power mode@ 100% load;
- the trailer is a 12 meters ISO high cube container;
- total dry weight of generator system without trailer is about 22,680 kilograms;
- the sound level is at 72 dB at 7 meters at full load of the motor engine in free field conditions;
- at peak power, the smaller rearward air fan 46 generates an air flow of about 20,000 cubic feet per minute (CFM), while the larger frontward air fan 48 would generate an air flow of about 40,000 (CFM).

The arrangement of trailer 12 which is partitioned into three different compartments 32, 34, 36, and which has a single integral fan assembly 46, 48, comprises the following advantages:

1) Due to the axial suction of plenum fan 46, 48, the front and rear air flows are more efficient in cooling the radiators and flywheel respectively, which reduces energy consumption of the power generator.
2) The single fan assembly reduces production cost and also reduces maintenance, in addition to having the very important advantage of reducing the noise emanating from the trailer 12, compared to two or more air fans, some of which being provided directly in front of an air outlet port.
3) Particularly advantageous and unexpected results have been obtained with the system according to the present invention, in reducing the noise emanating from trailer 12, due to the particular configuration of trailer 12, and more particularly due to the converging air flows created by an internal plenum fan, with the air flows expelled through a single top outlet port.
4) While the two fan portions 46, 48 integrally rotate as a single fan assembly, thus at a same rotational speed, the proportion of air sucked by rear air fan 48 relative to front air fan 46 is still regulated when fan assembly 46, 48 is produced, by placing fan plate 53 so as to provide a longer front fan portion 48 and a shorter rear fan portion 46.

The noise reduction is a highly rated advantage. Indeed, it is highly desirable to have a mobile generator unit such as trailer 12, which will be less noisy than other generator units, ceteris patibus. The plenum fan is less noisy than conventional flat fans, and a single integrally rotating fan assembly is required, thus significantly reducing the aerodynamic turbulence-borne noise. Also, the fact that the fan does not have to be installed directly in front of an air intake port or an air outlet port, further helps to reduce the noise from trailer 12. Finally, the partitions in trailer 12 also help to reduce sound propagation.

Figure 5:
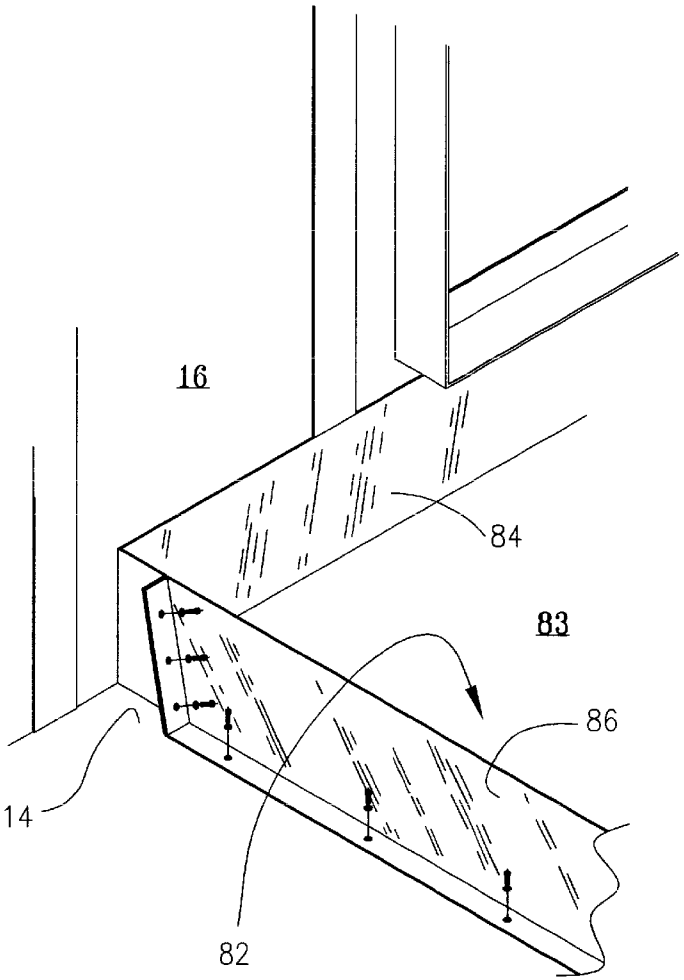
FIG. 5 is an enlarged perspective view of the inner rear corner of the trailer of FIG. 1, showing the fluid containment vat located on the container floor.

FIG. 5 shows the inner corner of container or trailer 12. It can be seen that there is provided inside trailer 12, a fluid containment tub or vat 82 resting on the floor 14 thereof. Vat 82 comprises a bottom wall 83 flatly resting on container floor 14, a pair of short side walls 84 (with only one side wall being shown in FIG. 5) upstanding from bottom wall 83, and a short front wall (not shown) and a short rear wall 86 also upstanding from bottom wall 83. The side walls and front and rear walls are all sealingly connected to bottom wall 83 and to one another, so as to form a fluid-tight containment vat 82. Thus, if accidental liquid leakage occurs, for example originating from the hydraulic circuit linking the radiators and the motor or from the fuel tank, then the liquid will remain in vat 82.

We claim:

1. A container for use in carrying a mobile power generator assembly, comprising:

a peripheral wall defining a generally closed inner chamber;

a first and second transverse partition wall inside said container inner chamber separating said inner chamber into a first and a second compartments and an intermediate compartment between said first and second compartments, with said first compartment for carrying a motor therein and with said second compartment for carrying a radiator assembly therein for operative linkage of said radiator assembly to said motor for cooling said motor;

a first fresh air intake port provided in said trailer peripheral wall in said first compartment, for cooling said motor;

a second fresh air intake port provided in said trailer peripheral wall in said second compartment, for cooling said radiator assembly;

a hot air outlet port provided in said trailer peripheral wall in said intermediate compartment, for exhausting warm air from said inner chamber;

a first air channel linking said first and intermediate compartments;

a second air channel linking said second and intermediate compartments; and a plenum air fan assembly provided in said intermediate compartment for operative connection to said motor and rotating about a rotational axis radially offset relative to said hot air outlet port, said plenum air fan assembly comprising a first and a second coaxially extending fan portions separated and integrally linked to a fan plate diametrally extending in said plenum fan between said first and second fan portions, said first fan portion being positioned in facing operative register with said air channel for sucking gases out of said first compartment and expelling these gases out through said hot air outlet port, and said second fan portion being positioned in facing operative register with said second air channel for sucking gases out of said second compartment and expelling these gases out through said hot air outlet port, with said second fan portion being axially longer than said first fan portion, for providing a greater air flow in said second compartment than in said first compartment.

2. A container as defined in claim 1, wherein said peripheral wall defines a floor, two side walls, two end walls, and a ceiling, with said first and second fresh air intake port being provided in either one of said side walls and said end walls, and with said warm air outlet port being provided in said ceiling.

3. A container as defined in claim 2, further comprising a fluid containment vat located on said floor and including a bottom wall flatly resting on said floor, and two vat side walls and two vat end walls upstanding from said bottom wall in a fluid-tight manner.

4. A container as defined in claim 3, wherein one of said container end walls is formed by a door that can be opened to allow access into said container, with said vat having a removable vat end wall registering with said door.

5. A mobile generator unit as defined in claim 1, wherein said first fan portion creates an air flow of approximately 20 000 CFM while said second fan portion creates an air flow of approximately 40 000 CFM.

6. A mobile generator unit as defined in claim 1, wherein said peripheral wall and said first and second transverse partition walls are acoustically insulated.

7. A mobile generator unit comprising:

a generally closed container having a peripheral wall defining an inner chamber;

a first and second transverse partition wall inside said container inner chamber separating said inner chamber into a first and a second compartments and an intermediate compartment between said first and second compartments;

a power generating motor carried by said container in said first compartment;

a radiator assembly carried by said container in said second compartment and operatively linked to said motor for cooling said motor;

a first fresh air intake port provided in said trailer peripheral wall in said first compartment, for cooling said motor;

a second fresh air intake port provided in said trailer peripheral wall in said second compartment, for cooling said radiator assembly;

a hot air outlet port provided in said trailer peripheral wall in said intermediate compartment for exhausting warm air from said inner chamber;

a first air channel linking said first and intermediate compartments;

a second air channel linking said second and intermediate compartments; and a plenum air fan assembly provided in said intermediate compartment, operatively connected to said motor and rotating about a rotational axis radially offset relative to said hot air outlet port, said plenum air fan assembly comprising a first and a second coaxially extending fan portions separated and integrally linked to fan plate diametrally extending in said plenum air fan assembly between said first and second fan portions, said first fan portion being positioned in facing operative register with said first air channel for sucking air out of said first compartment and expelling this air out through said hot air outlet port, and said second fan portion being positioned in facing operative register with said second air channel for sucking air out of said second compartment and expelling this air out through said hot air outlet port, with said second fan portion being axially longer than said first fan portion for providing a greater air flow in said second compartment than in said first compartment.

8. A mobile generator unit as defined in claim 7, wherein said first fan portion creates an air flow of approximately 20 000 CFM while said second fan portion creates an air flow of approximately 40 000 CFM.

9. A mobile generator unit as defined in claim 7, further comprising a third fresh air intake port in said second compartment, wherein said radiator assembly comprises a pair of radiators each positioned in facing, adjacent register with a respective one of said second and third fresh air intake ports.

10. A container as defined in claim 7, wherein said peripheral wall defines a floor, two side walls, two end walls, and a ceiling, with said first and second fresh air intake port being provided in either one of said side walls and said end walls, and with said hot air outlet port being provided in said ceiling.

11. A container as defined in claim 10, further comprising a fluid containment vat located on said floor and including a bottom wall flatly resting on said floor, and two vat side walls and two vat end walls upstanding from said bottom wall in a fluid-tight manner.

12. A container as defined in claim 11, wherein one of said container end walls is formed by a door that can be opened to allow access into said container, with said vat having a removable vat end wall registering with said door.

13. A mobile generator unit as defined in claim 7, wherein said peripheral wall and said first and second transverse partition walls are acoustically insulated.

14. A mobile generator unit comprising:

a generally closed container having a peripheral wall defining an inner chamber;

a first and a second transverse partition wall inside said container inner chamber separating said inner chamber into a first and a second compartments and an intermediate compartment between said first and second compartments;

a power generating motor carried by said container in said first compartment;

a radiator assembly carried by said container in said second compartment and operatively linked to said motor for cooling said motor;

a first fresh air intake opening provided in said trailer peripheral wall in said first compartment, for cooling said motor;

a second fresh air intake opening provided in said trailer peripheral wall in said second compartment, for cooling said radiator assembly, with said first fresh air intake opening being smaller than said second fresh air intake opening;

a hot air outlet port provided in said trailer peripheral wall in said intermediate compartment for exhausting warm air from said inner chamber;

a first air channel linking said first and intermediate compartments;

a second air channel linking said second and intermediate compartments; and an air fan assembly provided in said intermediate compartment and operatively connected to said motor, said air fan assembly having a first fan portion connected to said first air channel for sucking air out of said first compartment and expelling this air out through said hot air outlet port, and a second fan portion connected to said second air channel for sucking air out of said second compartment and expelling this air out through said hot air outlet port, with said second fan portion having a greater air flow debit rate that said first fan portion.

15. A mobile generator unit as defined in claim 14, wherein said second fresh air intake opening comprises a pair of fresh air intake ports.

16. A mobile generator unit as defined in claim 15, wherein said first fresh air intake opening comprises a single fresh air intake port.

17. A mobile generator unit as defined in claim 14, wherein said air fan assembly is a plenum fan assembly, with said first and second fan portions being integrally linked to each other by means of a plate separating said first and second fan portions.

18. A mobile generator unit as defined in claim 14, wherein said peripheral wall and said first and second transverse partition walls are acoustically insulated.

* * * * *